US005358376A

United States Patent [19]

van den Top

[11] Patent Number: 5,358,376

[45] Date of Patent: Oct. 25, 1994

[54] DEVICE FOR OPENING AND EMPTYING FILLED FOOD CANS

[76] Inventor: Hendrik van den Top, Bellstraat 19, 3771 AH Barneveld, Netherlands

[21] Appl. No.: 33,399

[22] Filed: Mar. 19, 1993

[30] Foreign Application Priority Data

Mar. 20, 1992 [NL] Netherlands ..... 9200521

[51] Int. Cl.[5] ..... B30B 9/00

[52] U.S. Cl. ..... 414/412; 198/377; 222/87

[58] Field of Search ..... 414/412; 222/80, 87; 198/377, 605, 626.1, 626.5; 83/151, 410, 412–414, 435, 946

[56] References Cited

U.S. PATENT DOCUMENTS

| | | | |
|---|---|---|---|
| 1,469,398 | 10/1923 | Street | 414/412 X |
| 3,187,876 | 6/1965 | Simpson | 198/377 |
| 3,269,515 | 8/1966 | Hill | 198/377 |
| 3,270,788 | 9/1966 | Armstrong | 198/377 X |
| 3,294,264 | 12/1966 | Everington | 414/412 |
| 3,530,971 | 9/1970 | Babunovic | 198/377 |
| 3,682,341 | 8/1972 | Happel . | |
| 3,939,998 | 2/1976 | Soltermann . | |
| 3,957,168 | 5/1976 | Shine et al. | 215/1 C |
| 4,330,288 | 5/1982 | Russell et al. | 198/377 X |
| 4,340,152 | 7/1982 | Ehholm, Jr. | 222/87 X |
| 4,396,340 | 8/1983 | Clinton | 414/412 |
| 4,735,368 | 4/1988 | Janko et al. | 414/412 X |
| 4,859,132 | 8/1989 | Chasseray | 414/412 |

*Primary Examiner*—Michael S. Huppert
*Assistant Examiner*—James W. Keenan
*Attorney, Agent, or Firm*—Webb Ziesenheim Bruening Logsdon Orkin & Hanson

[57] ABSTRACT

The device for opening and emptying filled food cans comprises a conveyor path. Food cans are gripped in the conveyor path using semi-cylindrical clamping elements. In addition the cans are clamped on the end walls. Placed in the conveyor path is a knife for cutting through the can. Using the clamping elements on the end walls the can halves are turned over and emptied. The can halves are subsequently ejected into a reservoir.

16 Claims, 1 Drawing Sheet

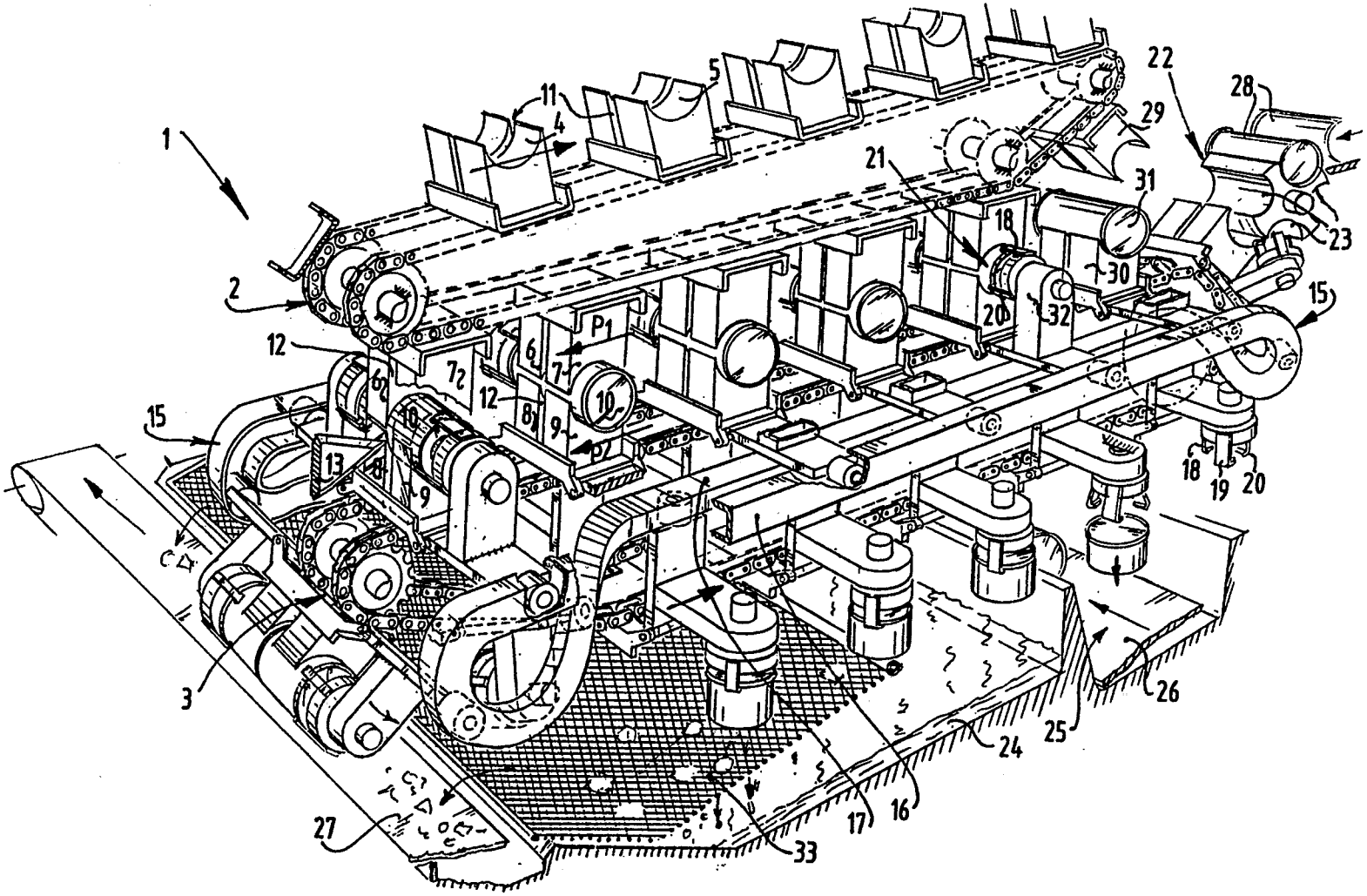
1
2
3
4
5
6
7
8
9
10
11
12
13
15
16
17
18
19
20
21
22
23
24
25
26
27
28
29
30
31
32
33
P1

DEVICE FOR OPENING AND EMPTYING FILLED FOOD CANS

BACKGROUND OF THE INVENTION

The contents of food cans dented for instance by a fall are no longer suitable for human consumption because the protective inner foil for example is damaged. Equally unsuitable for human consumption are the contents of food cans wherein a determined period of time, for instance one or two years, has passed since the filling date.

Up to the present, such cans have been placed in the environment in filled state, usually with the domestic refuse at a dump-site. For environmental reasons resulting from the presence of metal, this is no longer permitted. Such food cans no longer fit for use were also destroyed in incinerators. However, the processing price has recently increased very sharply.

SUMMARY OF THE INVENTION

There is therefore a need for an environmentally-friendly manner of processing such food cans at an acceptable cost and with the maximum possible re-use of the contents and of the material of the cans themselves.

In order to enable this, a device is provided according to the invention for opening and emptying filled food cans with clamping means connecting onto a feed device and movable in a conveyor path, which means are displaceable between an inactive, open position and an active, closed position clamping round a can, a knife placed in the conveyor path and means placed behind the knife as seen in the direction of movement for causing the can portions to perform a pivoting movement between the position in the conveyor path and a position differing therefrom.

With such an automatically operating device food cans can be opened and the contents thereof collected in a reservoir at an acceptable cost, while the cans or at least the portions thereof are themselves collected for re-use. The collected contents of the food cans is virtually always biodegradable and can optionally be used for instance for animal feed.

According to a preferred embodiment the device comprises movable claws for gripping in the conveyor path the end walls of a can received in the clamping means, wherein the means for causing the can portions to perform a pivoting movement are the claws moved through the guide track. Due to the pivoting movement the can is emptied in operationally reliable manner.

Other features and characteristics will become clear from the description of an embodiment as according to the annexed drawing.

BRIEF DESCRIPTION OF THE DRAWING

The drawing is a perspective view of an embodiment according to the invention.

DESCRIPTION OF THE PREFERRED EMBODIMENT

The device for opening and emptying filled food cans comprises a conveyor path 1 defined by an upper chain conveyor 2 and a lower chain conveyor 3. Each of the conveyors 2 and 3 carries similarly shaped cylindrical elements, for instance 4, 5, 6, 7, 8 and 9, placed at regular mutual intervals. Conveyors 2 and 3 are arranged mutually such that the cylindrical elements, for instance

6 and 7, on the lower part of conveyor 2 enclose, together with the cylindrical elements 8 and 9 on an upper part of the lower conveyor 3, a cylindrical space for receiving a food can for processing, for instance 10. In transverse direction the cylindrical elements are divided into two part-elements leaving free a gap, for instance 11, 12. A knife 13 oriented toward the gap 12 in the part elements is placed in the conveyor path. Arranged to the side of the conveyor path for each pair of cylindrical elements 1 are claws formed by three claw fingers, for instance 18, 19, 20, disposed in a circle. The claw fingers can be moved between an open position and a closed position, for instance at the claw 21 where they engage on a can on the end wall. The claws are moved along with the conveyors and therein guided using rollers in the U-shaped guide track 15. The guide track has a part 16 wherein the U-shaped opening faces toward the conveyor path and a part 17 wherein the open portion of the U faces vertically downward. At the feed end of the device the part 17 transposes into the part 16 and at the discharge end the path of part 16 transposes into the part 17. Can are supplied using a feed device 22 consisting of rotating disc with openings, for instance 23, for receiving a can.

Below the device are two collecting reservoirs 24 and 25 as seen in lengthwise direction. A cross conveyor 26 is placed in reservoir 25 while a discharge conveyor 27 connects onto reservoir 24. The whole is driven by an electrical motor (not drawn).

The device operates as follows.

During operation the disc 22 rotates synchronously with the conveyors 2 and 3 which also run synchronously with each other. A can having opposed end walls and a sidewall, for instance 28, is supplied by a disc to the device. The upper conveyor 2 follows a path of movement such that a semi-cylindrical element 29 approaches the conveyor path 1 via an inclining path and therein clamps round the can 31 placed in the meantime on a lower semicylindrical element 30. The end walls of the can are also gripped on both sides by a pair of movable claws, for instance 32, on the one side and a claw (not shown) on the other side. Both conveyors 2 and 3 move further in the direction of arrows P1 and P2. At the end of the conveyor path the can, in this case 10, meets the knife 13 and is cut through thereby during the reversing movement at the end of the conveyor path. At this position, the semi-cylindrical elements of the upper conveyor 2 and the lower conveyor 3 release the can that has been cut through. The resultant can portions are each held by the adjacent claws.

Due to the pivoting movement of the claws, which in the meantime have left the conveyor portion 16 and are following the conveyor portion 17, which occurs after the knife with respect to a direction of movement of the clamping means in the conveyor path, the can halves move into the vertical position so that the contents thereof leave the can portions due to the force of gravity and enter the reservoir 24. The latter can be provided with a grid 33 so that a separation takes place between solid and liquid parts. The solid parts can then be carried by a means of a transporting movement of the grid to the conveyor 27. In addition, spray cleaning means (not drawn) may also be present at the position of reservoir 24. Above the reservoir 25 the claws disengage and the can half falls onto the conveyor 26 and is carried off sideways. The cycle is then repeated.

I claim:

1. A device for opening and emptying filled food cans having opposed end walls and a sidewall, the device comprising:

a feed device for bringing cans into the opening and emptying device;

a conveyor path along which cans are moved in the opening and emptying device;

clamping means for receiving a can from the feed device and movable in the conveyor path, said clamping means adapted to be displaceable between an inactive, open position and an active, closed position clamping around said sidewall of the can;

a pair of movable claws for gripping the opposed end walls of the can received in the clamping means as the can moves along the conveyor path has;

a knife placed in the conveyor path for slicing through said sidewall to open the can and means positioned after the knife with respect to a direction of movement of the clamping means in the conveyor path for causing portions of the can held in said movable claws to perform a pivoting movement between a first position in the conveyor path and a second pivoting position differing therefrom to empty the can, wherein the means for causing portions of the can held in said movable claws to perform the pivoting movement includes a guide track along which said movable claws move.

2. A device as claimed in claim 1, wherein the clamping means comprises two approximately semi-cylindrical elements.

3. A device as claimed in claim 2, wherein the semi-cylindrical elements have a transverse central gap and the knife is oriented toward the gap.

4. A device as claimed in claim 2, wherein the semi-cylindrical clamping elements are each placed on a plurality of endless conveyors arranged one above the other and running parallel to each other to define the conveyor path, wherein the plurality of endless conveyors include an upper conveyor having a lower part and a lower conveyor having an upper part, whereby the lower part of the upper conveyor faces toward the upper part of the lower conveyor.

5. A device as claimed in claim 4, wherein the knife is disposed in a stationary position close to a reversing point of the endless conveyors.

6. A device as claimed in claim 4, wherein the lower conveyor includes a reversing point that is in a remote position from the knife, the reversing point is located close to the feed device, which comprises a rotary feed disc with a number of circle sector-like peripheral recesses and wherein the rotation of the feed disc and the movement of the conveyors are synchronous and in phase.

7. A device as claimed in claim 6, wherein the upper conveyor has a path inclining over a limited distance toward the conveyor path at the reversing point located close to the rotary feed disc.

8. A device as claimed in claim 1, wherein the conveyor path includes sides and each of the claws is arranged on its own conveyor disposed on either side of the conveyor path, and control means are present for opening and closing the claws and further wherein the pivoting movement is performed through an angle of approximately 90°.

9. A device as claimed in claim 1, wherein the movable claws are opened at a distance after the pivoting position with respect to the conveyor path.

10. A device as claimed in claim 7, further including a first collecting reservoir positioned vertically beneath the pivoting position to collect the contents of the cans and a second collecting reservoir positioned vertically beneath the opening position of the claws to collect the empty cans.

11. A device as claimed in claim 10, further including a movable sieve belt placed vertically above the first collecting reservoir.

12. A device as claimed in claim 1, wherein the knife is wedge-shaped and has a point which is oriented toward approximately a center of a space defined by the clamping means.

13. A device for opening and emptying filled food cans having end walls, the device comprising:

a feed device for bringing cans into the opening and emptying device;

a conveyor path along which cans are moved in the opening and emptying device;

clamping means for receiving a can from the feed device and movable in the conveyor path, said clamping means adapted to be displaceable between an inactive, open position and an active, closed position clamping around a can, wherein the clamping means includes two approximately semi-cylindrical elements, each placed on a plurality of endless conveyors arranged one above the other and running parallel to each other to define the conveyor path, wherein the plurality of endless conveyors include an upper conveyor having a lower part and a lower conveyor having an upper part, whereby the lower part of the upper conveyor faces towards the upper part of the lower conveyor;

a knife placed in the conveyor path for opening the can; and means positioned after the knife with respect to a direction of movement of the clamping means in the conveyor path for causing portions of the can to perform a pivoting movement between a first position in the conveyor path and a second pivoting position differing therefrom to empty the can.

14. A device as claimed in claim 13, wherein the lower conveyor includes a reversing point that is in a remote position from the knife, the reversing point is located close to the feed device, which comprises a rotary feed disk with a number of circle sector-like peripheral recesses and wherein the rotation of the feed disk and the movement of the conveyors are synchronous and in phase.

15. A device as claimed in claim 14, wherein the upper conveyor has a path inclining over a limited distance toward the conveyor path at the reversing point located close to the rotary feed disk.

16. A device for opening and emptying filled food cans having end walls, the device comprising:

a feed device for bringing cans into the opening and emptying device;

a conveyor path along which cans are moved in the opening and emptying device;

clamping means for receiving a can from the feed device and movable in the conveyor path, said clamping means adapted to be disposable between an inactive, open position and an active, closed position clamping around a can;

movable claws for gripping end walls of a can received in the clamping means as the can moves along the conveyor path;

a knife placed in the conveyor path for opening the can;

means positioned after the knife with respect to a direction of movement of the clamping means in the conveyor path for causing portions of the can to perform a pivoting movement through an angle of approximately 90° between a first position in the conveyor path and a second pivoting position differing therefrom to empty the can, wherein the means for causing portions of the can to perform the pivoting movement includes a guide track along which the movable claws move, and further the conveyor path includes sides and each of the claws is arranged on its own conveyor disposed on either side of the conveyor path; and control means for opening and closing the claws.

* * * * *

UNITED STATES PATENT AND TRADEMARK OFFICE

CERTIFICATE OF CORRECTION

PATENT NO. : 5,358,376

DATED : October 25, 1994

INVENTOR(S) : Hendrik van den Top

It is certified that error appears in the above-indentified patent and that said Letters Patent is hereby corrected as shown below:

Column 2 Line 22 "Can" should read --Cans--.

Column 2 Line 40 "semicylindrical" should read --semi-cylindrical--.

Claim 1 Line 16 Column 3 delete "has".

Claim 10 Line 1 Column 4 "7" should read --9--.

Claim 16 Line 66 Column 4 after "gripping" insert --the--.

Claim 16 Line 3 Column 6 after "further" insert --wherein--.

Signed and Sealed this

Third Day of January, 1995

Bruce Lehman

*Attest:*

BRUCE LEHMAN

*Attesting Officer*

*Commissioner of Patents and Trademarks*